US007151502B2

(12) United States Patent
Stavros et al.

(10) Patent No.: US 7,151,502 B2
(45) Date of Patent: Dec. 19, 2006

(54) PHASED ANTENNA ARRAY MODULE

(75) Inventors: Andy Stavros, San Jose, CA (US); Ming Tsai, Sunnyvale, CA (US); Stuart E. Wilson, Menlo Park, CA (US)

(73) Assignee: Tessera, Inc., San Jose, CA (US)

( * ) Notice: Subject to any disclaimer, the term of this patent is extended or adjusted under 35 U.S.C. 154(b) by 0 days.

(21) Appl. No.: 11/025,397

(22) Filed: Dec. 29, 2004

(65) Prior Publication Data

US 2006/0139210 A1 Jun. 29, 2006

(51) Int. Cl.
*H01Q 21/00* (2006.01)

(52) U.S. Cl. ..... 343/853

(58) Field of Classification Search ..... None
See application file for complete search history.

(56) References Cited

U.S. PATENT DOCUMENTS 3,500,428 A * 3/1970 Allen ..... 342/371
5,741,462 A * 4/1998 Nova et al. ..... 422/68.1
6,320,546 B1 11/2001 Newton et al.
2003/0197124 A1* 10/2003 Wood ..... 250/332
2004/0012518 A1* 1/2004 Mohan ..... 342/357.1
2004/0176805 A1* 9/2004 Whelan et al. ..... 607/2

* cited by examiner

*Primary Examiner*—Tho Phan
(74) *Attorney, Agent, or Firm*—Lerner, David, Littenberg, Krumholz & Mentlik, LLP

(57) ABSTRACT

A phased antenna array is disclosed. The phased antenna array is composed of one or more modules and has a plurality of antenna. The array has a plurality of antenna configured to operate as an array and each module has at least one antenna. The modules have a substrate that supports the antenna, a microelectronic device for sending signals to or receiving signals from said antenna and conductive traces that connect that antenna to the microelectronic device. In those embodiments where the phased antenna array has more than one module, a common substrate supports the one or more modules. A combination of circuitry and interconnects achieves the desired electrical interconnection between the modules.

19 Claims, 6 Drawing Sheets

PHASED ANTENNA ARRAY MODULE

BACKGROUND OF THE INVENTION

The present invention relates to a phased antenna array and a transmit or receive (T/R) module configured for the array. The modules contain integrated circuits mounted on lightweight or flexible substrates that have antennas integrated with associated interconnect circuitry.

Radio frequency (RF) and microwave T/R modules are used in a variety of communications systems. One exemplary use of such modules is a phased antenna array. Traditionally, RF and microwave T/R modules are packaged in kovar or aluminum housings. The modules are formed on alumina or other ceramic substrates. Such hybrid modules are both heavy and large.

Various package designs for incorporating advanced microelectronics for different types of circuitry in a single microelectronic package have been proposed. Examples of different types of circuitry include analog, digital and RF amplification and modulation/demodulation circuitry. Often, the microelectronic package is required to be lightweight, compact, provide electromagnetic shielding, and be capable of dissipating excess heat, without requiring additional power-consuming components such as fans and refrigeration equipment. Stacked packaging is, therefore, desirable because it is somewhat light and compact, yet provides adequate shielding and heat dissipation.

The challenges associated with providing low cost lightweight microelectronic packages are exacerbated when seeking to manufacture systems such as phased antenna arrays that operate at high frequencies (10 kHz and above). A prior art phased antenna array 10 is depicted in FIG. 1. The array 10 is formed on a heavy alumina substrate 15 that supports a variety of both ICs 20 and microwave components 25. Multiple antenna elements 30 are printed on the heavy alumina substrate.

Such systems are complicated because multiple RF and microwave ICs and multiple antennas are required. Because of these requirements, such systems are both heavy (due to the hermetic housing) and expensive to manufacture. Mismatch associated with the RF connectors to the individual antenna can also be a problem. Also, as noted in U.S. Pat. No. 6,320,546 to Newton et al., the disclosure of which is incorporated by reference, it is often necessary to have the planar antenna orthogonal yet electrically connected to the circuitry that accomplishes beam forming. This further complicates the assembly and packaging of such systems. Accordingly, an inexpensive way to manufacture a phased antenna array is sought.

SUMMARY OF THE INVENTION

The present invention is directed generally to RF components, configured as modules that can function independently or as a multi-module system. In one embodiment, the module is configured to operate as a phased antenna array. In other embodiments, multiple modules are assembled together to form a phased antenna array. Embodiments of the present invention are lightweight modules that are configured to operate as an RF component that sends and receives signals within a predetermined operating frequency. Although the operating frequency is largely a matter of design choice, it is advantageous if the operating frequency is a frequency in the range of about 3 Hz to 300 GHz. In certain embodiments, the modules are configured for high frequency applications and operate in the range of 1 GHz to 300 GHz.

Each module contains at least one antenna with an associated microelectronic device. The antenna and microelectronic device are supported on a module substrate. The microelectronic device in the module has transmit, receive, or transmit and receive (transceiver) circuitry. Consequently, the modules are referred to generically as T/R modules herein. The circuitry in the T/R modules is configured to work in cooperation with its associated antenna to either send or receive (or both transmit and receive) signals wirelessly. The module is configured to weigh about 10 grams or less. In certain embodiments, the module is configured to weigh 5 grams or less. In further embodiments, the module is configured to weigh 2 grams or less.

The module substrate also functions as a circuit board for the other constituents of the RF component. The substrate therefore supports interconnect circuitry in electrical communication with the microelectronic device of the one or more modules. In those embodiments wherein the system is comprised of multiple modules, the system either has a common module substrate supporting the individual modules or the individual modules are formed directly on and are supported by a common substrate. In these embodiments, each individual module has its own interconnect circuitry in electrical communication with one or more antenna elements configured as an operative array of antennas.

The T/R modules themselves typically have a plurality of circuits in the form of one or more microelectronic devices and associated interconnect circuitry. The module circuitry is typically combined RF, analog and digital circuitry. The T/R circuits are electrically connected with their associated antenna via interconnect circuitry associated with the module. In one embodiment, the microelectronic device in the module includes a transmitter that generates RF signals and communicates those signals to the antennas. The transmitter is configured to provide a phase to the antenna elements. The phase being applied to an individual antenna element in one module is coordinated with the phase applied to other antenna elements in that same module or other modules (if the array has more than one module). These small and lightweight modules are incorporated into, by way of example, nanosatellites, aerospace and other devices or instruments or apparatus in which low weight, compact components are desired.

It is advantageous if the T/R module is compact. Advantageously, the size of the T/R module will be on the order of a chip scale package. The desired size of the chip scale package is described more completely herein. Since the T/R module is formed in a chip scale package, it meets the dual objective of being small and lightweight. A phased array antenna system that uses more than one of such modules is similarly small and lightweight.

In one embodiment, the phased antenna array is formed of one module having a plurality of antennas. In another embodiment, the phased antenna array is formed from a plurality of modules. In this embodiment, each module in the array has at least one antenna and the modules themselves are a sub array of the larger phased antenna array system. Using this modular construction and design, failure of a single T/R circuit may not require replacement of the entire module. If more than one T/R circuit fails, however, replacement of the entire module may be required. Additional advantages of the present invention include the fact that a hermetic housing (e.g. a kovar housing) is not required over the T/R circuits. A hermetic housing is not required because chip scale encapsulants and materials provide the environmental protection afforded by the hermetic housing. Furthermore the weight and the cost of manufacture of antenna/RF connector pairs are reduced by this configuration. Because the antennas and the IC interconnects can be, at least in part, printed on the substrates that form part of the module, it is very inexpensive to fabricate the T/R modules of the present invention.

The substrates themselves, either the module substrate, the common substrate or both, are formed on a flexible dielectric material. The material can have properties such as dielectric constant and loss tangent that are tailored for this application. In the context of the present invention, the dielectric constant is tailored to have a value of $\in_k$ that is less than about 10. It is also advantageous if the material has a loss tangent that is less than about 0.005. Examples of such flexible dielectric materials that can be tailored to have the above-identified properties include polyimide, liquid crystal polymer (LCP), bis-maleimide triazine (BT) resin or epoxy-fiberglass materials (e.g. FR-4).

As previously noted, one of the applications of the T/R module is as a chip scale package in a phased antenna array. A phased antenna array consists of multiple stationary antenna elements which are fed with variable phase, time-delay, or amplitude control at each element to scan a beam to a given angle in space. The T/R modules of the present invention make a lightweight, compact, inexpensive phased antenna array a reality by introducing an antenna or an array of antennas into a chip scale package.

DETAILED DESCRIPTION

Figure 1:
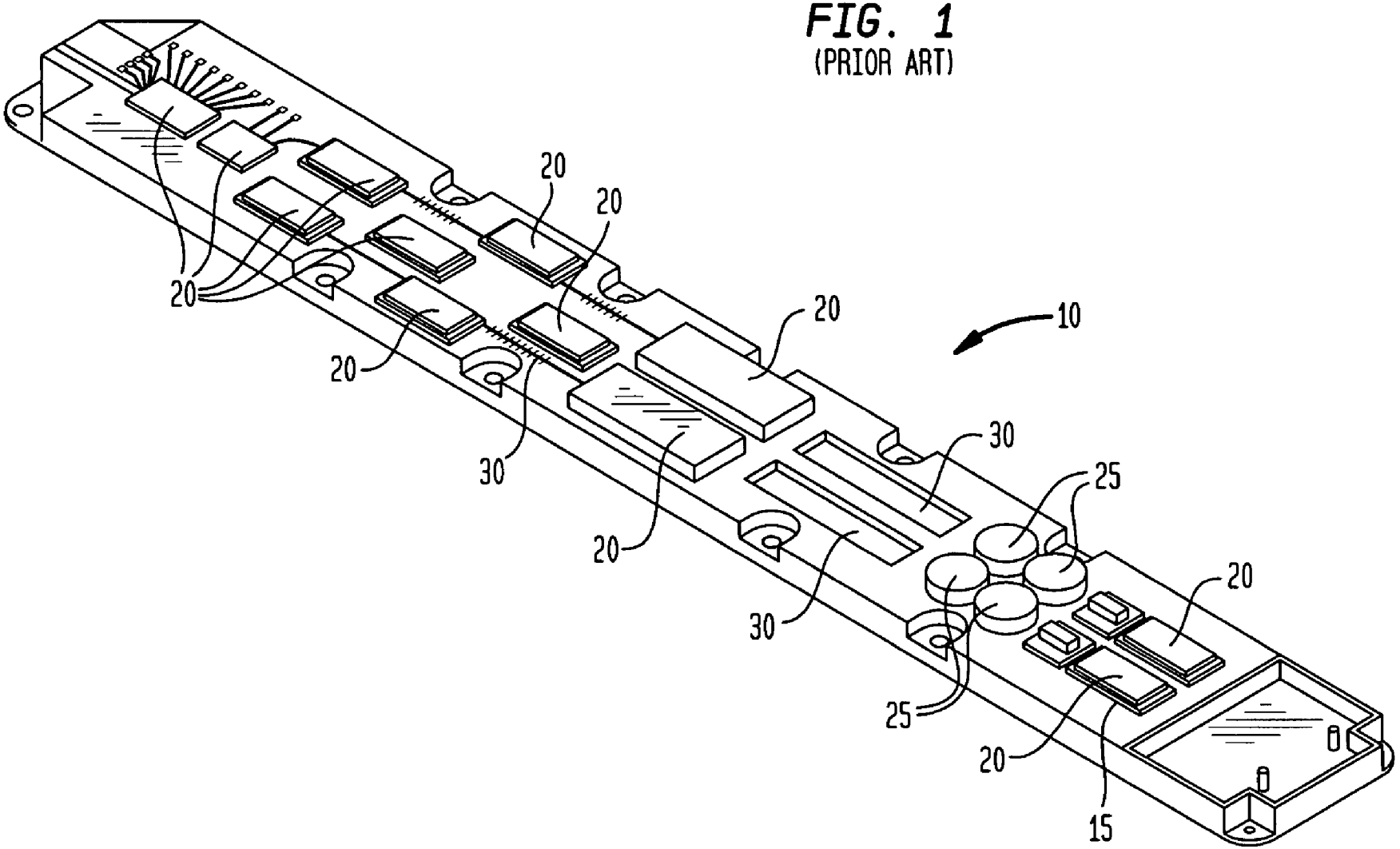
FIG. 1 (PRIOR ART)
FIG. 1 is side view of a conventional phased antenna array system of the Prior Art.

Certain embodiments of the present invention provide a low-cost, lightweight phased array antenna. In one embodiment the phased array antenna system consists of a single module. Module, as used herein is a unit assembly having at least one microelectronic component, at least one antenna element, and interconnect circuitry between the antenna and the at least one microelectronic component. It is advantageous if the module is configured as a chip scale package (CSP). In embodiments wherein the module is a phased antenna array, the module has at least two antenna elements and the entire array is supported by a single module substrate.

In other embodiments, the phased antenna array is made up of more than one module. In these embodiments, each module has at least one microelectronic element, at least one antenna element, and interconnect circuitry connecting the at least one antenna element with the microelectronic element. In some of these multi-module embodiments, each module has its own substrate and all are supported by a system array substrate. In other embodiments, the components of each module (i.e. antennas, microelectronic element and interconnects) are supported by a common substrate. Individual module substrates and common module substrates are referred to generically herein as module substrates.

It is advantageous if the module substrate is made of a lightweight material. Lightweight materials for circuit panel applications are well known to one skilled in the art and are not disclosed in detail herein. The module substrate supports conductors that are either routed on the surface of the module substrate, within the module substrate, or beneath the surface of the module substrate. The module substrate is, advantageously, made of a material that has a dielectric constant and other properties tailored for this application. In one embodiment of the present invention, the dielectric constant is tailored to have a value of $\in_k$ that is less than about 10. In other embodiments, the substrate material is tailored to have a loss tangent that is less than 0.005. Examples of lightweight materials having properties that can be tailored to have the values specified above include polyimide, liquid crystal polymer (LCP), bis-maleimide triazine (BT) resin or epoxy-fiberglass materials (e.g. FR-4).

The T/R module has at least one active microelectronic (e.g. IC) element that is supported by the module substrate. The module substrate further supports one or more antenna elements. The RF interconnect between the antenna and its associated IC device is also supported by the module substrate. The IC devices contain the circuitry required to transmit, receive or transmit and receive signals from the antenna, other components in the module, or both. IC devices that transmit and receive signals are typically referred to as transceivers.

The antenna elements are integrally associated with the interconnect circuit traces of the module. In some embodiments the antenna is simply an extension of the trace. IC circuits for the phased array described herein include, by way of example and not by limitation, phase shifter and amplifier circuits. A variable phase shifter changes the output signal phase by applying a variable control signal. These circuit elements are well known to one skilled in the art and are not described in detail herein. Such circuits can be either analog or digital. Furthermore, in at least some embodiments of the phased array system disclosed herein, associated circuitry will be distributed between the individual modules and the array substrate. For example, the array substrate may be configured to support an integrated passive network, filters, etc., in addition to the individual modules.

As previously noted, the T/R modules are configured to provide an array of antenna elements. Thus, if a module is a single channel module with only one antenna, a plurality of such modules is required to form the phased antenna array. If a module has multiple channels (i.e. more than one antenna) the phased antenna array can be formed from one or more of such modules.

The T/R modules include transmitter circuitry that is configured to receive signals from the antenna and to generate RF signals and send those signals to the antenna. Consequently, the transmitter circuitry (more aptly the IC devices that contain the transmitter circuitry) are electrically connected to both the conductors of any off module components such as a power supply to which the module is connected and to the one or more antenna elements of such module. The transmitter circuitry operates to control the phase of the signal applied to the antenna elements using phase shifters as described above. In one embodiment, the I/C devices receive signals though the conductors from off module components (e.g. other modules). In this embodiment, an off-module controller transmits a signal to the IC and the signal received by the IC in the T/R module causes the receiver to generate a beam forming signal that is applied to the associated antenna element. This signal causes the antenna to transmit a signal of a particular phase. A variable phase shifter changes the output signal phase by applying a variable control signal. The two broad types of variable phase shifters are analog and digital. Analog phase shifters change the output phase by means of an analog signal (usually voltage). A digital phase shifter uses a digital signal to change the output phase.

In another embodiment, the phased array antenna system is configured such that the IC device in the module has a circuit element that is adapted to receive RF signals from its associated antenna element. The IC device then transmits the received signal (or, in alternate embodiments, some information about the received signal) through electrical interconnections between the IC device and other components either in the same module, a different module or other component electrically interconnected with the module. In this embodiment, the IC device is also adapted to receive control signals from other components either in the same module, a different module of other component, depending upon the particular embodiment. The control signal instructs the receive circuit to precondition the received signal with a predetermined phase shift, time shift or amplitude weight (i.e. gain). The control signal provides this instruction based upon either predetermined or measured conditions.

In a preferred embodiment of the present invention, the T/R module is assembled into a chip scale package using one of a variety of packaging technologies. In one embodiment, depicted in FIG. 2A, the T/R module 100 includes a packaged transceiver module 110 (illustrated as formed from a several subcomponents 111, 112 and 113 embedded in a plastic encapsulant 114). Plastic encapsulant materials for integrated circuit packaging applications are well known to one skilled in the art and are not described in detail herein. One skilled in the art familiar with materials for integrated circuit applications can readily select a suitable plastic encapsulant material for the components illustrated in the embodiments described herein.

The transceiver module is supported by an interconnect module substrate 105. The module substrate has a bottom surface 120 and a top surface 130. Module substrate 105 can be made of a variety of materials, including, but not limited to, polyimide, liquid crystal polymer (LCP), bis-maleimide triazine (BT) resin or epoxy-fiberglass materials (e.g. FR-4). The module substrate can be flexible or rigid. Module substrate 105 has associated interconnect circuitry typically in the form of conductive traces (not shown). The traces can be formed on one or more surfaces of the module substrate 105. The module 100 also has an antenna 140 formed on the surface 120 of the substrate 105. The module substrate 105 also supports components 115 and 155. Component 115 is an integrated circuit chip and component 155 is either an active or passive component, depending upon the application for the particular module.

Figure 2A:
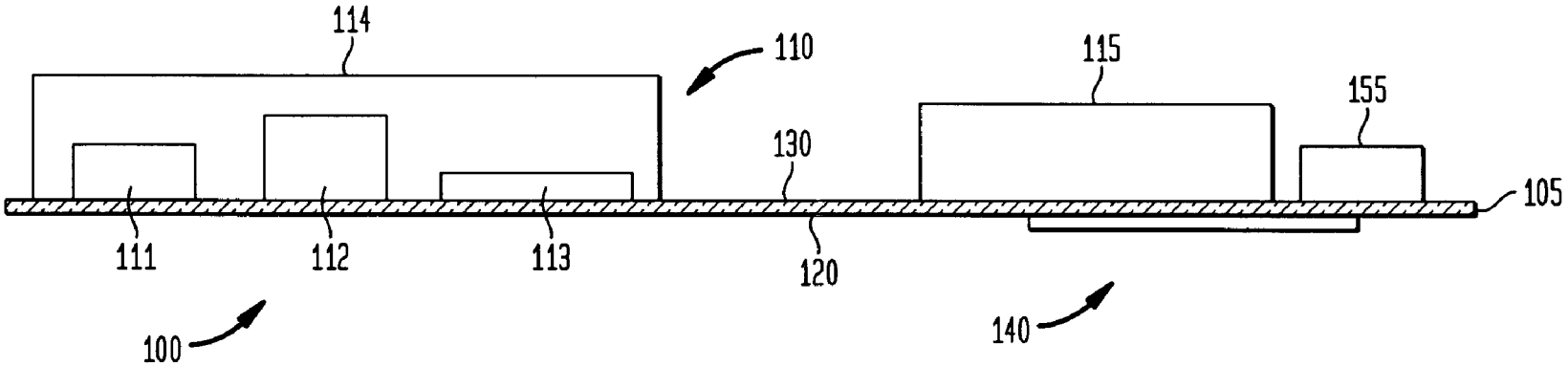
FIGS. 2A and 2B are side views of the module according to one embodiment of the present invention in both its unfolded form (FIG. 2A) and its unfolded form (FIG. 2B)
Figure 2B:
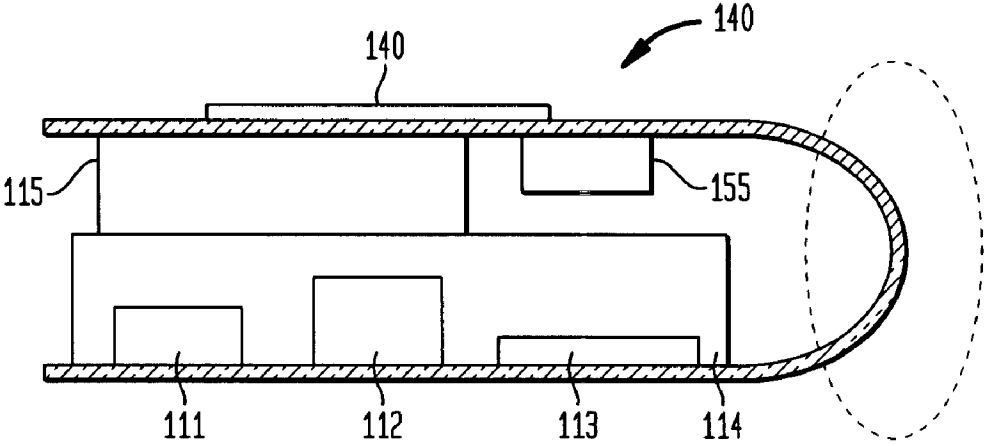

In FIG. 2B, the module 100 from FIG. 2A is folded over on itself. Antenna 140, formed on the bottom surface of the substrate, is now on the top of the module 100. Thus, in this structure, the module substrate portion 105 is interposed between antenna 140 and the other module components 110 and 115. Chip 115, containing associated digital or analog circuitry, is affixed opposite transceiver module 110 in module 100. It is advantageous if the antenna 140 is formed on module substrate 105 using conventional techniques (i.e., printing, lithography). For example, circuit-forming techniques of the type used to form traces on printed circuit boards are contemplated as suitable.

In the illustrated embodiment, chip 115 and component 155 are depicted as packaged chips. Conventional plastic encapsulants are contemplated as suitable packaging materials.

A method for making the type of folded package illustrated in FIG. 2B is disclosed in U.S. patent application Ser. No. 10/746,810, which is commonly owned and hereby incorporated by reference. This method utilizes a ribbon-like substrate on which an RF chip is mounted on a lower level, and the substrate is then folded over, and another chip such as a digital or analog chip is mounted to the folded-over portion.

Figure 3:
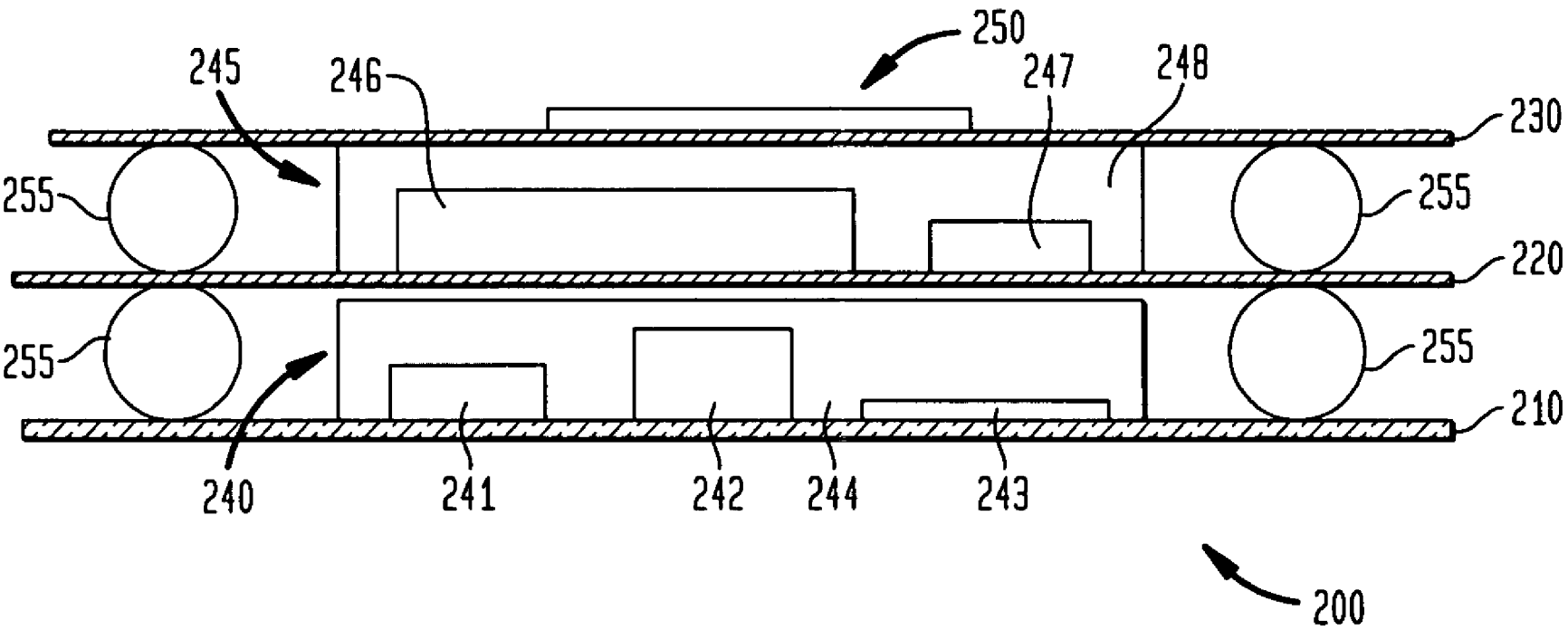
FIG. 3 is a side view of a phased antenna array in a stacked chip scale package configuration.

An alternative embodiment of the present invention is illustrated in FIG. 3. In this embodiment, the module 200 is depicted in a stacked configuration. In this configuration, multiple substrates, 210, 220 and 230 are used. The substrates are made of the plastic dielectric materials previously described.

The module components are distributed among the various substrates. In the depicted embodiment, package 240 is mounted on substrate 210. Package 240 has components 241, 242 and 243 thereon. These components can be a variety of active and passive components, and components are depicted generically for the sake of illustration. In one illustrative example, the package 240 contains IC device 241. Components 242 and 243 are also depicted for illustrative purposes. Components 242 and 243 can be either active or passive components depending upon the particular application for the module. These additional components are optional, and their selection depends upon the requirements for the particular application. The components 241, 242 and 243 are assembled into package 240 using a conventional plastic encapsulant 244 as the packaging material. Component 240 is then mounted on and electrically connected to substrate 210 using conventional technology well known to those skilled in the art. The substrate 210 contains interconnect structure (not shown). The interconnect structure places the components in package 240 in electrical communication with the components in package 245 and printed antenna 250. The interconnect structure consists of conductive traces (not shown) formed either on or embedded in substrates 210, 220 and 230. The interconnect structures in substrates 210, 220 and 230 are further connected through interconnects 255. In the embodiment depicted in FIG. 3, interconnects 255 are solder balls.

The stacked structure 200 also contains a second package 245. Package 245 contains a T/R component 246 and another associated component 247. T/R component 246 and 247 are depicted as embedded in a plastic encapsulant material 248. Component 247 is illustrated generically, and can be a variety of active or passive components depending upon the desired functionality for module 200. In one embodiment component 247 can be a clocking component for sending and receiving signals either to or from the T/R component 246 to or from, respectively, the antenna component 250. Although one printed antenna element 250 is illustrated in the side view provided by FIG. 3, it is contemplated that the structure can have a plurality of antenna elements 250.

An illustrative method for fabricating stacked packages such as the one illustrated in FIG. 3 is described in commonly owned U.S. patent application Ser. No. 10/746,810 filed Dec. 24, 2003 entitled "High Frequency Chip Packages with Connecting Elements," the disclosure of which is hereby incorporated herein by reference. The reference describes stacked packaging for housing ICs having different types of circuitry. In such packaging, solder balls are used as an element for interconnecting circuit panels at the respective levels of the stack. Alternatively, the substrates can be interconnected with one another by interconnect elements resembling panel circuit boards as described in certain embodiments of U.S. Provisional Application No. 60/576,170 filed Jun. 2, 2004, the disclosure of which is incorporated by reference herein.

Figure 4A:
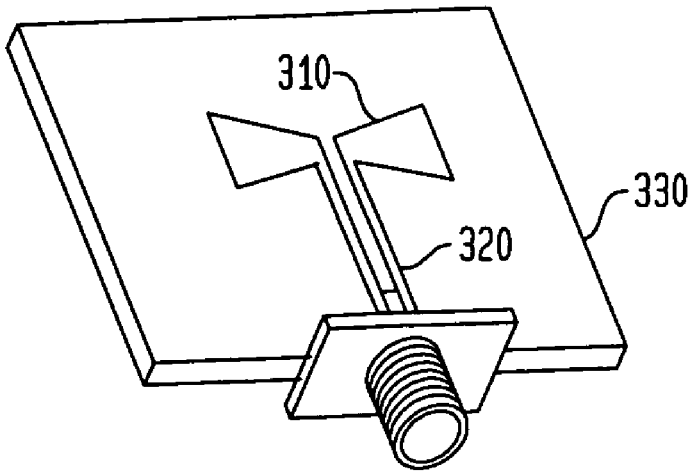
FIGS. 4A–4C are top views of printed antennas suitable for use in the present invention.
Figure 4B:
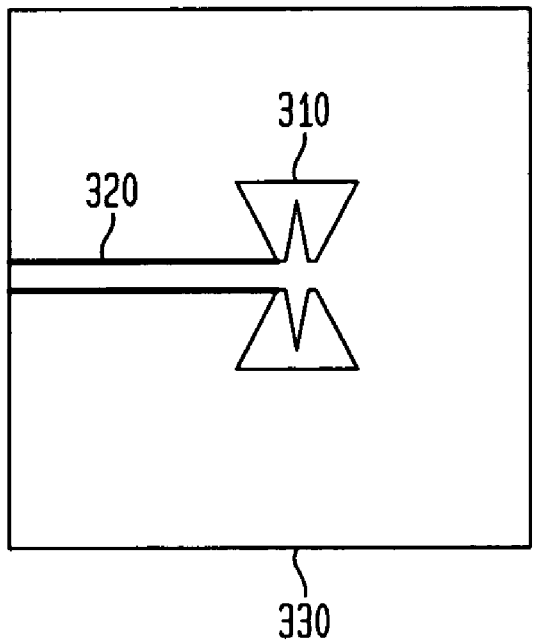
Figure 4C:
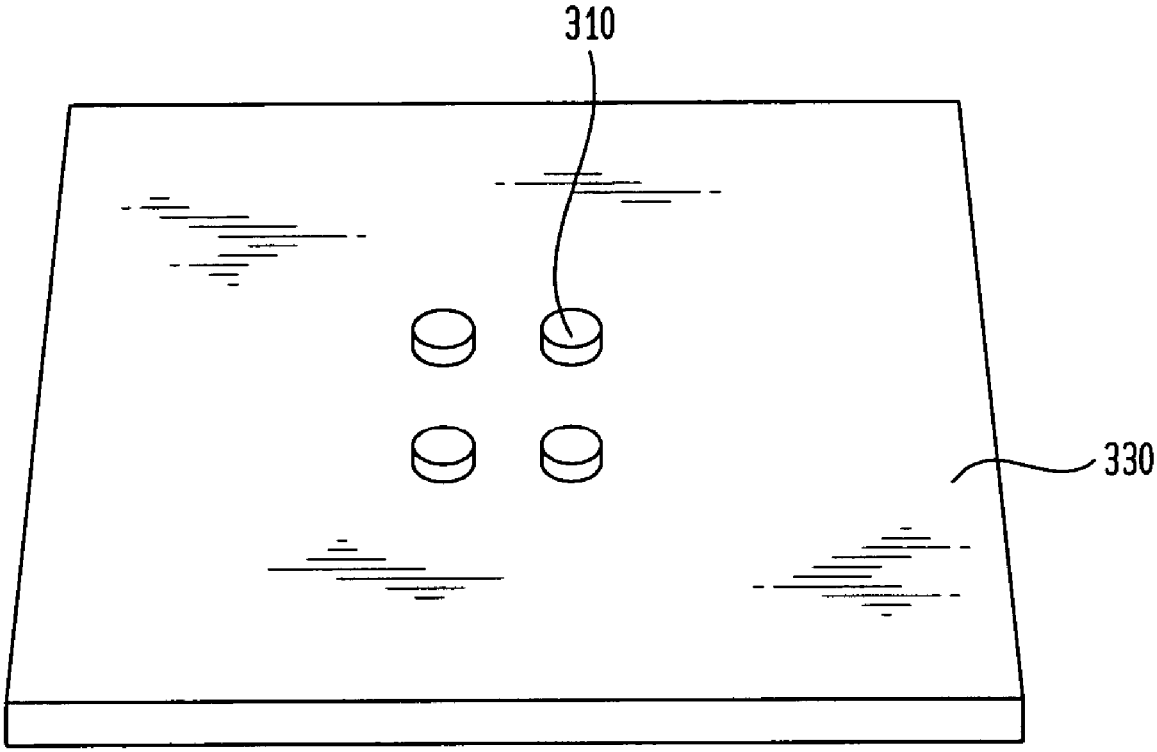

As previously noted, the module can contain one or more antenna elements. Plan views of different antenna element arrangements are illustrated in FIGS. 4A–4C. FIG. 4A depicts two approximately triangular antenna elements 310, with associated interconnect lines 320 printed on flexible dielectric substrate 330. An alternate configuration is illustrated in FIG. 4B. There, the individual antenna elements 310 have a different configuration from the roughly triangular configuration depicted in FIG. 4A. In the embodiment depicted in FIG. 4C, the four individual antenna elements 310 are interconnected to associated circuitry in the module (not shown) through interconnect circuitry embedded in substrate 330 and therefore not visible in the top, plan view.

As previously noted, embodiments of the present invention provide a lightweight module that avoids the disadvantages of the much heavier modules previously used. As such, the module components (i.e. antenna, microelectronic elements, substrates etc.) are selected to ensure that the components collectively weigh less than about 10 grams. It is advantageous if the collective weight of the components is less than about 5 grams. In some embodiments, the components collectively weigh less than 2 grams. It is also advantageous if the assembled module weighs less than 10 grams. In some embodiments the module weighs less than 5 grams. In other advantageous embodiments the module weighs less than 2 grams.

Figure 5:
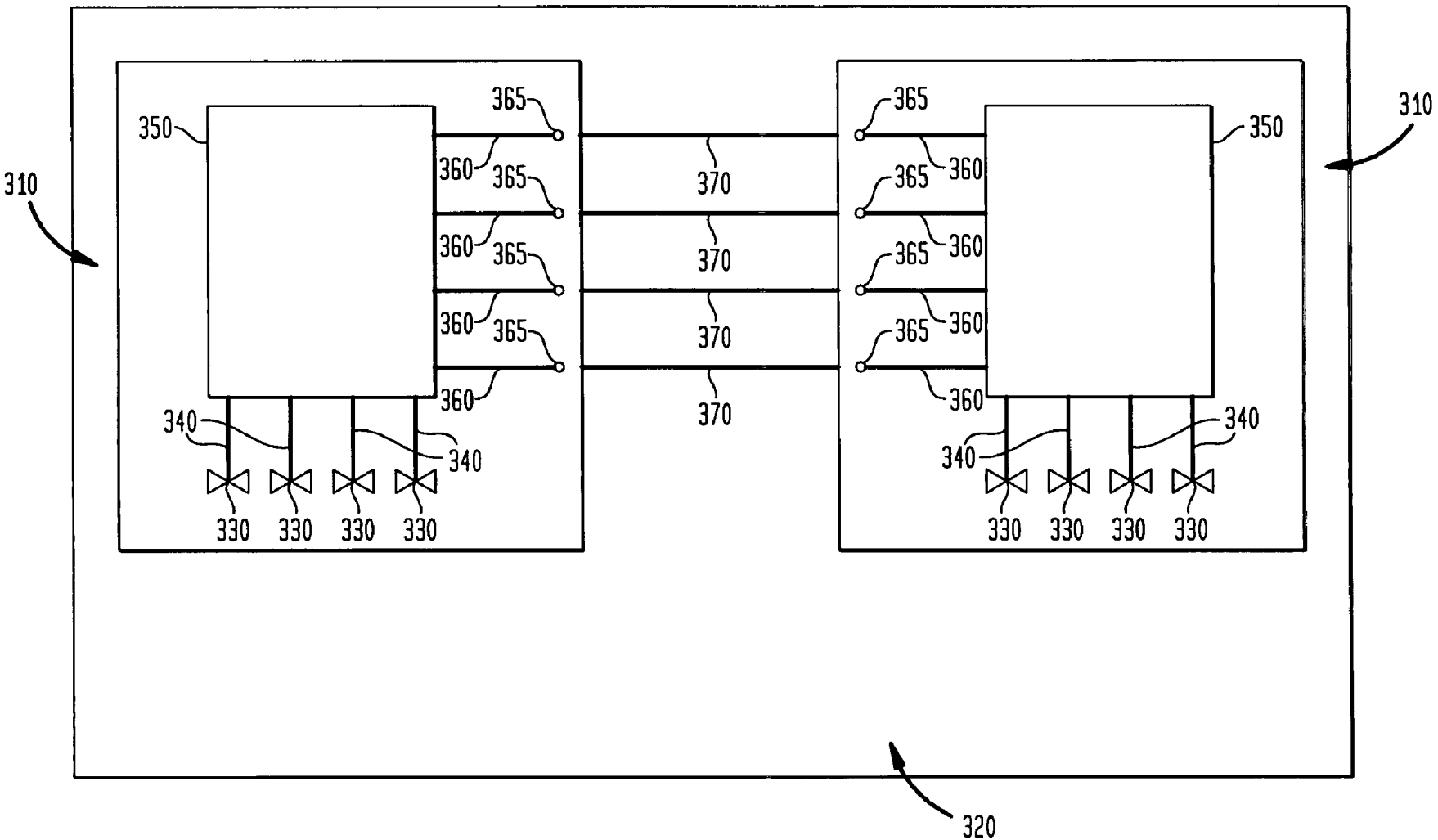
FIG. 5 is a schematic of one embodiment of a multi-module phased antenna array according to the present invention.

One embodiment of the present invention is depicted schematically in FIG. 5. Specifically, a phased array 300 having two modules 310 is illustrated as supported by common substrate 320. Multiple antenna elements 330 are illustrated as electrically interconnected to module circuitry traces 340. Module circuitry traces 340 interconnect the antenna elements 330 with functional blocks 350. Functional blocks 350 schematically illustrate the active and passive components of the modules 310. As previously discussed, the module 310 can be provided with a variety of circuitry (e.g. a master clock, controller, passive network, etc.) in addition to the T/R device in the module. In FIG. 5, block 350 is configured to control the timing and phase of signals transmitted to or from the antenna 330.

The modules are electrically interconnected via module traces 360, interconnects 365 and common substrate traces 370. Interconnecting the modules 310 allows the coordinated transmission of signals through antenna elements 330. Interconnecting the modules 310 also permits common clocking of the signals sent to and received from the antenna elements 330.

As previously noted, the phased array system of the present invention is formed using one of more modules. If more than one module makes up the array, the multiple modules are supported by a common substrate. Typically, the modules will be physically and electrically connected via traces on this common substrate. The modules are so connected using a variety of techniques well known to one skilled in the art. In one example, the module has a lower surface with exposed interconnects thereon. These interconnects can be affixed to the electrical interconnects on the common substrate using well known techniques such as solder bonding.

As previously noted, in a preferred embodiment, the module is a chip scale package. As used herein chip scale packages include: i) a module size less than 50 mm across, ii) a chip size package (i.e. a package with a surface area that is no more than 1.5 times the chip area; and iii) a near-chip-size package that has an area of no more than 3 times the chip area.

As previously noted, the T/R module of the present invention is contemplated as useful as a core building block of a phased antenna array. Such phased antenna arrays have uses in sophisticated radar systems as well as a variety of wireless communication applications. One of the advantages of constructing a phased antenna array from the modules of the present invention is that the modules could be "swapped out" of the larger system should a particular module fail. The modules of the present invention are particularly robust, since the modules typically will have multiple T/R circuits with multiple antennas. If a single circuit in the transceiver module were to fail, replacement of the module may not be required. If more than one T/R circuit fails, then the module may need to be replaced.

As previously noted, the phased antenna array of the present invention is formed from one or modules that are both mechanically supported by and electrically connected to a common substrate. Both the module and the common substrate are configured to facilitate electrical interconnection therebetween. Since the module is, in certain embodiments, provided in the form of a chip scale package, techniques for interconnection of chip scale packages to supporting/interconnect substrates are contemplated as suitable. Thus, the module is provided with interconnects that can be affixed to conductors on the common substrate using conventional techniques such as soldering. It is also contemplated that the modules will have pins that are configured to fit into receptacles therefore on the common substrate. Surface mount technologies and ball grid arrays are also contemplated as approaches for electrically interconnecting the modules to the main circuit panel substrate.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A module comprising:

a substrate supporting interconnect circuitry;

a plurality of microelectronic devices in electrical communication with said interconnect circuitry; and a plurality of antenna elements in electrical communication with at least one of said microelectronic devices in a manner that permits the devices to either transmit, receive or transmit and receive signals within an operating frequency range, wherein the substrate, devices, and antenna combined weigh no more than about 10 grams.

2. The module of claim 1, wherein the substrate, devices, and antenna combined weigh no more than about 5 grams.

3. The module of claim 2, wherein the substrate, devices, and antenna combined weigh no more than about 2 grams.

4. The module of claim 1, wherein the total weight of the module is less than about 10 grams.

5. The module of claim 4, wherein the total weight of the module is less than about 5 grams.

6. The module of claim 5, wherein the total weight of the module is less than about 2 grams.

7. The module of claim 1, wherein the antenna elements are arranged in an array.

8. The module of claim 1, further comprising a plastic encapsulant.

9. The module of claim 8 wherein the at least one microelectronic device is an integrated circuit chip packaged in the plastic encapsulant.

10. The module of claim 1, wherein the substrate is flexible.

11. The module of claim 1, wherein the substrate has a dielectric constant less than about 5.

12. The module of claim 1, wherein the substrate is made of a polymeric material.

13. The module of claim 1, wherein the substrate has a loss tangent that is less than about 0.001.

14. The module of claim 1, wherein the operating frequency range is 1 GHz to 300 GHz.

15. The module of claim 1, wherein the operating frequency range is 3 Hz to 1 GHz.

16. The module of claim 1, wherein the module has a total volume that is less than about 15 $cm^3$.

17. The module of claim 1, wherein the substrate is associated with a substrate footprint, the devices are associated with a device footprint, and the substrate footprint does not exceed the device footprint by more than about 25%.

18. The module of claim 1, wherein the module has an operating pressure range of about 0 to about 1 atmosphere.

19. The module of claim 1, wherein the plurality of microelectronic devices further comprise active and passive microelectronic devices.

* * * * *